US005312019A

United States Patent [19]

Tsao

[11] Patent Number: 5,312,019

[45] Date of Patent: May 17, 1994

[54] DISPENSER HAVING A REFILLABLE CUP

[76] Inventor: Ye-Ming Tsao, Rm No. 6-11, 6 Fl., No. 782, Ting Chou Rd., Taipei, Taiwan

[21] Appl. No.: 59,380

[22] Filed: May 11, 1993

[51] Int. Cl.[5] ..... B67D 5/06

[52] U.S. Cl. ..... 222/105; 222/205; 222/494; 222/496; 141/21; 141/347; 141/349

[58] Field of Search ..... 222/205, 105, 326, 405, 222/207, 494, 496; 141/18, 21, 22, 114, 346-349

[56] References Cited

U.S. PATENT DOCUMENTS

| | | | |
|---|---|---|---|
| 1,948,987 | 2/1934 | Laufe | 222/205 |
| 2,099,595 | 11/1937 | Brown | 222/105 |
| 3,246,807 | 4/1966 | Micallef | 222/207 |
| 3,705,668 | 12/1972 | Schwartzman | 222/207 |
| 3,873,003 | 3/1975 | Seiferth et al. | 222/105 X |
| 4,020,975 | 5/1977 | Stauffer | 222/105 X |
| 4,146,154 | 3/1979 | Mastman | 222/205 X |
| 4,413,757 | 11/1983 | Adler | 222/105 |
| 5,033,631 | 7/1991 | Nightingale | 222/105 X |

FOREIGN PATENT DOCUMENTS

| | | | |
|---|---|---|---|
| 544616 | 9/1922 | France | 222/105 |
| 23329 | of 1911 | United Kingdom | 222/105 |

*Primary Examiner*—Andres Kashnikow

*Assistant Examiner*—Anthoula Pomrening

*Attorney, Agent, or Firm*—Bacon & Thomas

[57] ABSTRACT

A freshness keeping cup including a cup body and a check valve disposed therein. A U-shaped fixing inner sleeve member and a fixing outer sleeve member are secured with the lower portion of the cup body. A leakproof ring and a top flange of a soft bellows member are clamped between the bottom of the inner sleeve member and a top surface of an upper slide sleeve of a slide assembly. An outer lower surface of a top flange of the upper slide sleeve abuts against an inner upper surface of the bottom portion of the outer sleeve member. A top flange of the middle slide sleeve is engaged in a bottom flange of the upper slide sleeve and a top flange of the lower slide sleeve is engaged in a bottom flange of the middle slide sleeve. An upward inward projection is formed on the top flange of the lower slide sleeve. Engaging grooves are formed on lower inner portion of the lower slide sleeve for engaging with corresponding engaging hooks of a bottom cover for securing the same. The bellows member is disposed within the upper slide sleeve and the middle slide sleeve for containing a liquid, whereby when the bottom cover is pressed upward, the liquid is permitted to flow through the check valve into the cup body for drinking.

1 Claim, 3 Drawing Sheets

DISPENSER HAVING A REFILLABLE CUP

BACKGROUND OF THE INVENTION

The present invention relates to a freshness keeping cup structure, and more particularly to a cup structure permitting an appropriate amount of liquid contained therein to be dispensed into an upper cup body for drinking.

The conventionally used liquid container is separated from a cup. Therefore, when a user wants to drink a liquid contained in a container, the liquid must be first poured into an additional cup and then the user can drink the liquid. This is inconvenient during travel or a picnic and the liquid is apt to spill out of the cup when the cup is not steadily placed on a stationary table or the like. Therefore, a container equipped with a cup body, having both liquid containing and drinking serving functions is needed. Moreover, such container preferably also has the function of keeping the freshness and warmness of the contained liquid and preventing the same from being oxidized or contaminated by air or dust.

SUMMARY OF THE INVENTION

It is therefore an object of the present invention to provide a freshness keeping cup which includes a liquid containing portion and a cup body, whereby the liquid can be dispensed from the containing portion into the cup body for drinking while the liquid left in the containing portion remains isolated from the air and fresh.

According to the above object, the cup structure of the present invention includes a cup body and a check valve disposed therein. The check valve has an upper ring portion, a connecting portion downward tapered from the ring portion and a lower conic base portion, the tip of which is connected with the lower end of the connecting portion. The lower half conic base portion can move upward to compress and bend the connecting portion. A U-shaped fixing inner sleeve member is secured with the cup body. A check valve seat is disposed at a central portion of the inner sleeve member whereby the conic base portion of the check valve can be fitted in the valve seat. A through hole is formed under the valve seat. A fixing outer sleeve member is secured on with the inner sleeve member. A leakproof ring and a top flange of a soft bellows member are clamped between the bottom of the inner sleeve member and a top surface of an upper slide sleeve of a slide assembly. The slide assembly includes an upper slide sleeve, a middle slide sleeve, a lower slide sleeve and a bottom cover, wherein the top flange of the middle slide sleeve is engaged in the bottom flange of the upper slide sleeve and the top flange of the lower slide sleeve is engaged in the bottom flange of the middle slide sleeve. An upward inward projection is formed on the top flange of the lower slide sleeve like a step portion. A recess is formed on the bottom of the bellow member for receiving the projection. Engaging grooves are formed on lower inner portion of the lower slide sleeve for engaging with corresponding engaging hooks of the bottom cover for securing the same, whereby when the bottom cover is pressed upward, the top projection of the lower slide sleeve urges the recess of the bellow member to move upward so that the liquid contained therein starts to flow and force the conic base of the check valve to open upward, permitting the liquid to flow through the hole into the cup body for drinking. The slide assembly and the outer sleeve member are provided with warmness keeping layer for keeping the temperature of the liquid contained in the bellow member.

DETAILED DESCRIPTION OF THE PREFERRED EMBODIMENT

Figure 1:
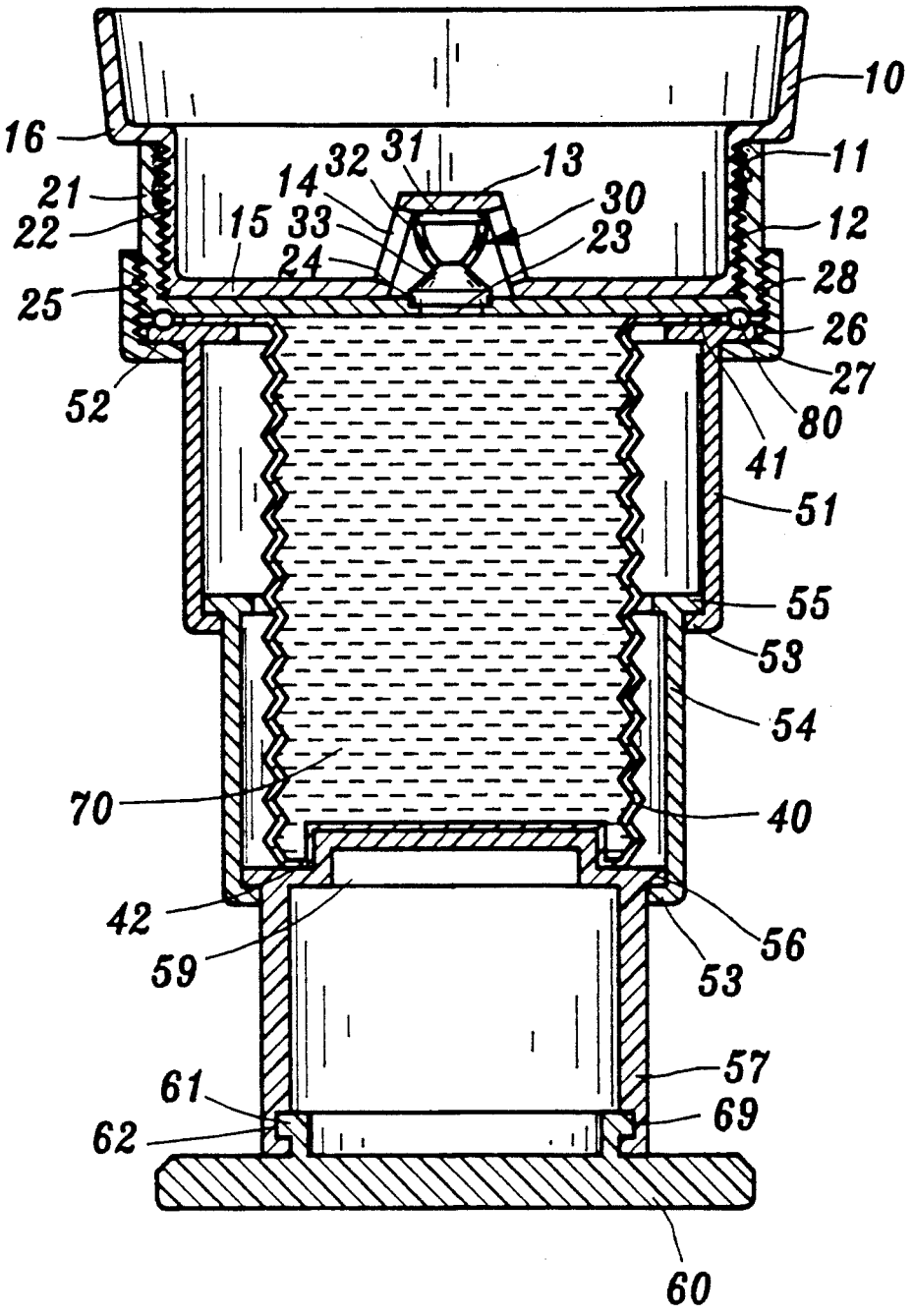
FIG. 1 is a sectional view of the present invention wherein the bellow member is totally stretched.

The freshness keeping cup of the present invention includes a cup body 10 and a check valve 30 disposed therein. The cup body 10 is stepped with an upper large diameter section and a lower small diameter section. A lower half portion of the lower section 11 of the cup body 10 is formed with male thread 12. A bottom section 15 of the cup body 10 is formed with a central conic projection 13 and several vent holes 14 are disposed around the projection 13 at equal intervals. The check valve 30 is disposed in the projection 13 and made of plastic material, having an uppper ring portion 31 disposed under the top of the projection 13 and a connecting portion 32 downwardly tapered from the ring portion 31 and a lower conic base portion 33, the tip of which is connected with the lower end of the connecting portion 32. The upper half portion of the check valve 30 is like a steering wheel while the lower half conic base portion 33 thereof can move upward to compress and bend the connecting portion 32. A U-shaped fixing inner sleeve member 21 having female thread 22 is screwed on the lower portion 11 of the cup body 10 with an upper end abutting against a step edge 16 of the cup body 10 and a lower end contacting the outer bottom surface of the cup body 10. A check valve seat 24 is disposed at a central portion of the inner sleeve member 21 whereby the conic base portion 33 of the check valve 30 can be fitted in the valve seat 24. A through hole 23 is formed under the valve seat 24. A fixing outer sleeve member 26 having female thread 28 is screwed on a lower portion of the inner sleeve member 21 having male thread 25. A leakproof ring 80 and a top flange 41 of a soft bellows member 40 are clamped between the bottom of the inner sleeve member 21 and a top surface 52 of an upper slide sleeve 51 of a slide assembly 50. An outer lower surface of the top flange 52 of the upper slide sleeve 51 abuts against an inner upper surface of the bottom portion 27 of the outer sleeve member 26. The check valve 30 can be made of rubber, plastic or metal materials.

Figure 2:
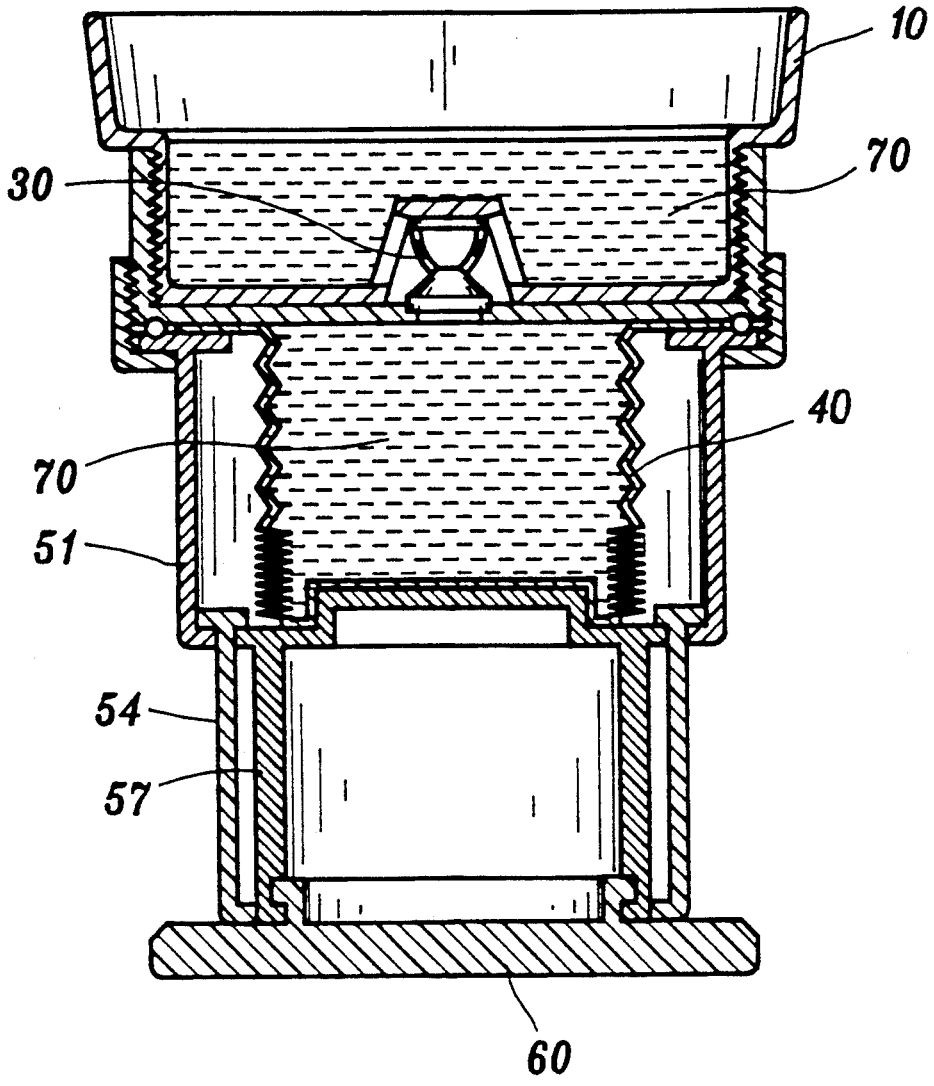
FIG. 2 is a sectional view according to FIG. 1, wherein the bellow member is half stretched.
Figure 3:
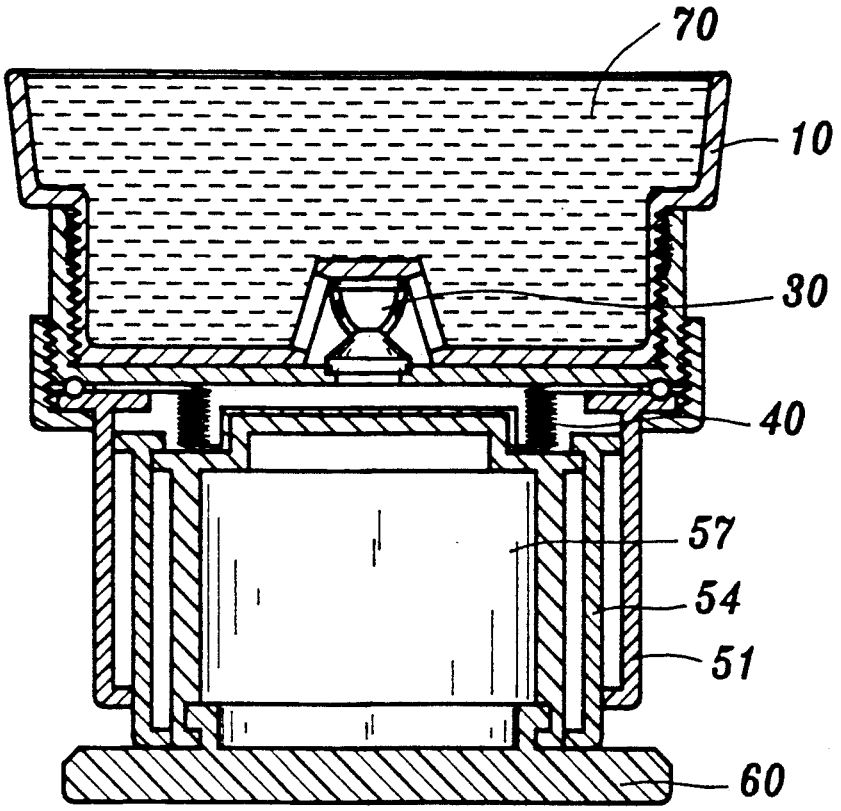
FIG. 3 is a sectional view according to FIG. 1, wherein the bellow member is completely contracted.

The slide assembly 50 includes an upper slide sleeve 51, a middle slide sleeve 54, a lower slide sleeve 57 and a bottom cover 60, wherein the number of the middle slide sleeve 54 can be varied in other embodiments of the present invention. The top flange 55 of the middle slide sleeve 54 is engaged in the bottom flange 53 of the upper slide sleeve 51 and the top flange 56 of the lower slide sleeve 57 is engaged in the bottom flange 53 of the middle slide sleeve 54. An upward inward projection 59 is formed on the top flange 56 of the lower slide sleeve like a step portion. A recess 42 is formed on the bottom of the bellow member 40 for receiving the projection 59. Engaging grooves 62 are formed on lower inner portion of the lower slide sleeve 57 for engaging with corresponding engaging hooks 61 of the bottom cover 60 for securing the same. The outer diameter of the bottom cover 60 is slightly larger than that of the upper slide sleeve 51 and the bellow member 40 is disposed within the upper slide sleeve 51 and the middle slide sleeve 54 for containing a liquid, whereby when the bottom cover 60 is pressed upward, the top projection 59 of the lower slide sleeve 57 urges the recess 42 of the bellow member 40 to move upward so that the liquid contained therein starts to flow and force the conic base 33 of the check valve 30 to open upwardly, permitting the liquid 70 to flow through the hole 23 into the cup body 10 as shown in FIG. 2. When the pressure disappears, the check valve 30 closes the hole 23 so that the bottom cover 60 can control the amount of liquid 70 entering the cup body 10 for drinking. When the bottom cover 60 reaches the lower end of the middle slide sleeve 54, the same is also urged to move upward into the upper slide sleeve 51 to continuously or discontinuously compress the liquid into the cup body 10 as shown in FIG. 3. The contracted bellow member 40 has a thickness which is equal to that of the upward projection 59 so that the liquid can be totally dispensed outward without remaining in the bellow member 40. Alternatively, the present invention can be placed on a table or the like with the cup body pressed downward to dispense the liquid outward.

According to the above arrangement, the present invention can be easily manufactured and assembled and can be conveniently carried. In addition, the present invention can be easily cleaned after used and supplemented with the liquid by means of turning the outer sleeve member and removing the same. A warmness keeping layer can be disposed on the slide assembly for keeping the temperature and the freshness of the contained liquid. Therefore, the safety and hygiene can be insured.

What is claimed is:

1. A freshness keeping cup comprising:

a cup body stepped with an upper section and a lower section, said lower section being formed with male threads and a bottom central conic projection, several vent holes being formed around said projection at equal intervals;

a check valve disposed under said projection and made of rubber, plastic or metal materials, having an upper ring portion disposed under the top of said projection and a connecting portion downwardly tapered from said ring portion and a lower conic base portion, the tip of which is connected with a lower end of said connecting portion, the lower conic base portion being able to move upward to compress and bend said connecting portion;

a U-shaped fixing inner sleeve member having female threads screwed onto the lower section of said cup body with an upper end abutting against a step edge of said cup body and a lower end contacting the outer bottom surface of said cup body, a check valve seat being disposed at a central portion of said inner sleeve member whereby the conic base portion of said check valve can be fitted in said valve seat, a through hole being formed under said valve seat;

a fixing outer sleeve member having female threads screwed onto a lower threaded portion of said inner sleeve member;

a soft bellows member having an upper flange, a bellow body and a bottom portion with an inward recess; and a slide assembly including an upper slide sleeve, a middle slide sleeve, a lower slide sleeve and a bottom cover, wherein a top flange of said middle slide sleeve is engaged in a bottom flange of said upper slide sleeve and a top flange of said lower slide sleeve is engaged in a bottom flange of said middle slide sleeve, an upward inward projection being formed on the top flange of said lower slide sleeve like a step portion, said recess formed on the bottom portion of said bellows member receives said projection, engaging grooves being formed on a lower inner portion of said lower slide sleeve for engaging with corresponding engaging hooks of said bottom cover for securing the same, the outer diameter of said bottom cover being slightly larger than that of said upper slide sleeve and said bellows member being disposed within said upper slide sleeve and said middle slide sleeve for containing a liquid, whereby when said bottom cover is pressed upward, the upward inward projection of said lower slide sleeve urges the recess of said bellows member to move upward so that the liquid contained therein starts to flow and forces said conic base portion of the check valve to open upward permitting the liquid to flow through said through hole into said cup body and when the pressure disappears, the check valve closes the vent holes so that said bottom cover can control the amount of liquid entering the cup body for drinking, and when said bottom cover reaches the lower end of said middle slide sleeve, the same is also urged to move upwardly into said upper slide sleeve to compress the liquid into said cup body, the contracted bellows member having a dimension which is equal to that of said upward projection so that the liquid can be totally dispensed outwardly without remaining in said bellows member.

* * * * *